United States Patent [19]

Berberich et al.

[11] Patent Number: 4,723,485

[45] Date of Patent: Feb. 9, 1988

[54] PROCESS AND APPARATUS FOR HIGH-SPEED TAMPON PRINTING

[75] Inventors: Bernd Berberich, Schwieberdingen; Günter Mieding, Remshalden, both of Fed. Rep. of Germany

[73] Assignee: TAMPOflex GmbH, Fed. Rep. of Germany

[21] Appl. No.: 918,127

[22] PCT Filed: Dec. 21, 1985

[86] PCT No.: PCT/DE85/00556

§ 371 Date: Nov. 5, 1986

§ 102(e) Date: Nov. 5, 1986

[87] PCT Pub. No.: WO86/04019

PCT Pub. Date: Jul. 17, 1986

[30] Foreign Application Priority Data

Jan. 7, 1985 [DE] Fed. Rep. of Germany ..... 3500291

[51] Int. Cl.[4] ..... B41F 17/00

[52] U.S. Cl. ..... 101/44; 101/163; 101/170

[58] Field of Search ..... 101/35, 41, 44, 150, 101/163, 170

[56] References Cited

U.S. PATENT DOCUMENTS

| | | | |
|---|---|---|---|
| 2,645,870 | 7/1953 | Smith et al. | 101/44 X |
| 3,299,804 | 1/1967 | Schueler | 101/35 |
| 3,418,926 | 12/1968 | Hakogi | 101/35 |
| 3,587,455 | 6/1971 | Childress et al. | 101/35 |
| 3,641,930 | 2/1972 | Riddington | 101/35 |
| 3,990,364 | 11/1976 | Paans | 101/129 |
| 4,414,892 | 11/1983 | Strafello | 101/35 X |

FOREIGN PATENT DOCUMENTS

| | | | |
|---|---|---|---|
| 169359 | 10/1982 | Japan | 101/41 |
| 124653 | 7/1983 | Japan | 101/35 |
| 1121816 | 7/1968 | United Kingdom | 101/35 |

*Primary Examiner*—Clifford D. Crowder

*Attorney, Agent, or Firm*—Thomas W. Speckman; Ann W. Speckman

[57] ABSTRACT

The invention relates to a process for high-speed tampon printing with tampons, printing blocks, and workpiece holders for the workpieces to be printed, where the workpieces are placed and held in the workpiece holders and where the tampons alternately receive printing images from the inked printing blocks and transfer them to the workpieces. The printing speed can be increased considerably by synchronously moving tampons, printing blocks, and workpieces respectively on an endless line, by arranging at least one section of the line with the tampons parallel to a section of the line with the printing blocks and at least one further section of the line with the tampons parallel to a section of the line with the workpieces and by moving them in the same direction, and by alternately adjusting the tampons perpendicular to the corresponding sections in the synchronous sections of the lines and by making them interact—for a given path—with an inked printing block for transferring the printing image and with a workpiece for receiving the printing image.

21 Claims, 3 Drawing Figures

PROCESS AND APPARATUS FOR HIGH-SPEED TAMPON PRINTING

BACKGROUND OF THE INVENTION

This invention relates to a process for high-speed printing with tampons, printing blocks, and workpiece holders for the workpieces to be printed, where the workpieces are placed and held in the workpiece holders and where the tampons alternately receive printing images from the inked printing blocks and transfer them to the workpieces.

DESCRIPTION OF THE PRIOR ART

Tampon printing machines are known where the printing block and the workpiece rest when the printing image is received and when it is transferred. Here, the tampon is adjusted in a linear motion, in most cases in three directions. After the transfer of the printing image the workpiece holder also executes a linear motion so that a new workpiece holder with a workpiece can be brought to the printing position.

With these tampon printing machines known in the art the printing speed is limited to a few hundred prints per hour, since the mechanical linear control elements allow only limited regulating speeds for the tampon and the workpiece holders.

SUMMARY OF THE INVENTION

It is an object of the invention to provide a process for high-speed tampon printing where the printing speed can be increased to a multiple of the prints.

According to the invention this object is achieved by synchronously moving the tampons, printing blocks, and workpieces respectively on an endless line, by arranging at least one section of the line with the tampons parallel to a section of the line with the printing blocks and at least one further section of the line with the tampons parallel to a section of the line with the workpieces, and by moving all of them in the same direction, and by alternately adjusting the tampons in the synchronous sections of the lines perpendicular to the corresponding sections and by bringing them into a position to interact—for a given travel path—with an inked printing block for receiving the printing image and with a workpiece for transferring the printing image.

The tampons, printing blocks, and workpiece holders with the workpieces can be moved along the endless lines at a considerably higher speed, and since printing is done by a brief lateral adjustment while the lines are moving, the printing cycles can be considerably increased, whereby a printing image can be received by a printing block in parallel with the transfer of a printing image to a workpiece and whereby several tampons, printing blocks, and workpiece holders can be arranged on the lines. This makes it possible to implement printing speeds which are far above the printing speed of the tampon printing machines with a resting printing block and a resting workpiece as they are known in the art. In addition, the design of the tampon printing machine for implementing the process is much simpler compared with the tampon printing machines known in the art.

If one embodiment provides that endless lines are configured as converyor belts, which are guided via deflection pulleys, that the tampons, printing blocks, and workpiece holders with the workpieces are arranged on the conveyor belts at an equal distance, and that the conveyor belts are moved continuously at a constant speed, then the drive of the conveyor belts is simplified and the sequence of motions can be easily synchronized.

According to one embodiment, optimum utilization of the time when the conveyor belts pass through the synchronous parallel sections for receiving the printing image and for transferring the printing image is achieved by adjusting the tampons perpendicular to the synchronous sections of the conveyor belts during the continuous run of the conveyor belts for a period of time which is coordinated with the period of time the conveyor belts take to pass through the synchronous sections.

If a further embodiment provides that the conveyor belts with the tampons, the printing blocks, and the workpiece holders are configured and driven the same way, that two tampons, two printing blocks, and two workpiece holders are provided which are spaced at a distance which is set by half the length of the conveyor belt, and that one parallel strand of the conveyor belt with the printing blocks is assigned to one strand of the conveyor belt with the tampons and one parallel section of the conveyor belt with the workpiece holders for workpieces is assigned to the other strand of the conveyor belt with the tampons, then the two strands of the conveyor belt with the tampons can be deflected in opposite directions when the synchronous sections facing each other pass through, so that a tampon receives a printing image on the side facing the conveyor belt with the printing blocks, while another tampon simultaneously transfers a printing image onto a workpiece on the side facing the conveyor belt with the workpiece holders. To ensure that the complete printing image is received and transferred one embodiment provides for adjusting the tampons perpendicular to the synchronous sections of the conveyor belts so that the tampons execute the required maximum path of deflection when receiving the printing image from the printing blocks and when transferring the printing image to the workpieces.

According to one embodiment, the adjusting motion of the tampons can be derived so that the tampons are adjusted or guided perpendicular to the synchronous sections by controlled deflection or guidance.

A controlled deflection or guidance of the strands of the conveyor belt can be achieved in a simple manner by providing a shunt with control curves for adjusting the strand of the conveyor belts, at which control curves the tampons are supported with control carriers. The control curves of the shunt are assigned to the two strands of the conveyor belt with the tampons.

According to one embodiment, the adjustment of the tampons for receiving the printing image from the printing blocks and to transfer the printing image to the workpieces can also be achieved by adjusting the tampons perpendicular to the corresponding synchronous sections of the conveyor belts by corresponding adjustment of the total conveyor belt with the tampons.

According to one embodiment, continuous inking of the printing blocks can be achieved by assigning an inking device to the strand of the conveyor which is turned away from the conveyor belt with the tampons, which inking device inks the printing blocks which are passing through it or are guided past it.

If a common drive mechanism is assigned to the conveyor belts, the synchronous movement of the conveyor belts is achieved automatically.

Feeding the workpiece holders with the workpieces to be printed and removing printed workpieces from the workpiece holders is facilitated by making the number of tampons equal to the number of printing blocks, by selecting a number of workpiece holders for workpieces which is greater than the number of tampons or printing blocks and by driving all three conveyor belts at the same operating speed. Then, the conveyor belt with the workpiece holders can be arranged so that it protrudes at both ends of the conveyor belt with the tampons which facilitates access to the workpiece holders in the protruding sections.

If provision is made to assign several conveyor belts with tampons to the conveyor belt with the workpiece holders, and to arrange the conveyor belts with the tampons in tandem in the direction of motion of the conveyor belt with the workpiece holders and to impart to them a rotating motion in the same direction and to assign each conveyor belt with tampons a conveyor belt with printing blocks and an inking device, then the process is suitable for multiple printing and multicolor printing.

BRIEF DESCRIPTION OF THE DRAWING

The invention is explained in more detail by means of various embodiments shown in the drawings. It is shown in FIG. 1 a schematic representation of a tampon printing machine for implementing the process according to the invention, FIG. 2 a schematic representation of a modified tampon printing machine for implementing the process according to the invention, and FIG. 3 a further variation of a tampon printing machine to implement the the process according to the invention.

DESCRIPTION OF PREFERRED EMBODIMENTS

Figure 1:
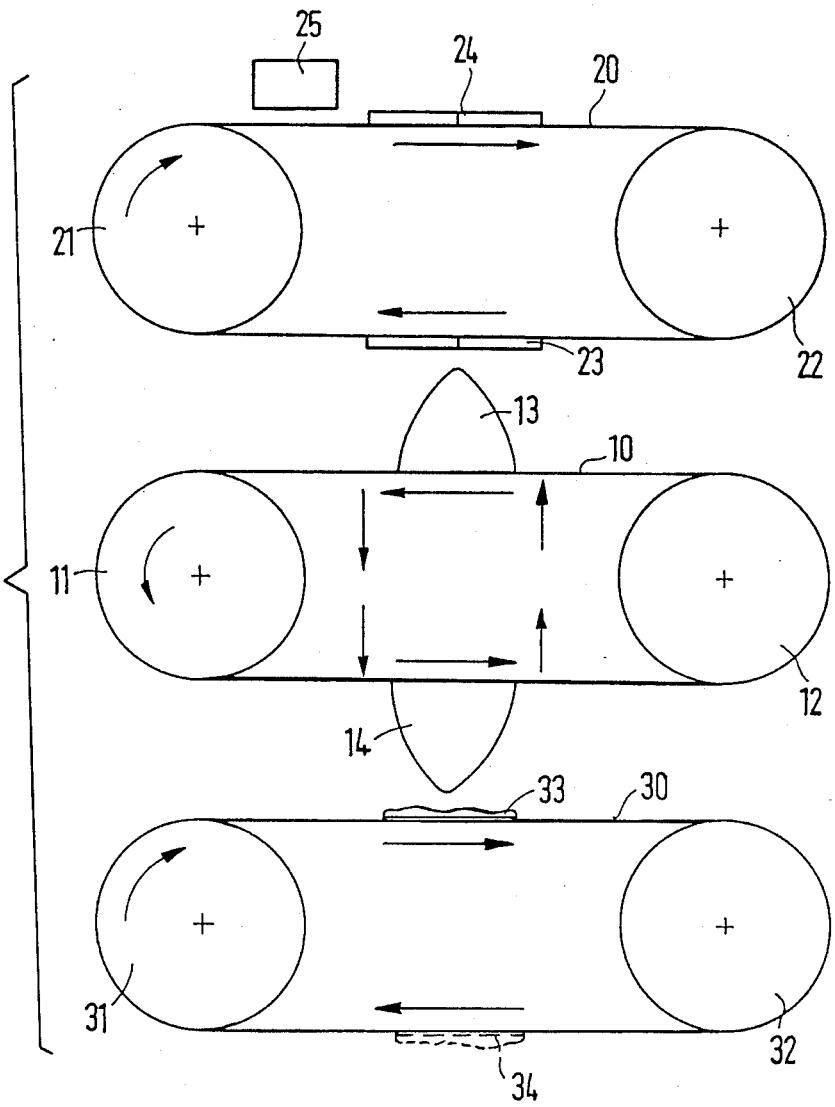

In the exemplified embodiment according to FIG. 1 three endless lines 10, 20, and 30 are formed by three continuous conveyor belts. The central conveyor belt forming line 10 carries tampons 13 and 14 and is guided around deflection pulleys 11 and 12. Tampons 13 and 14 are spaced at a distance corresponding to half the length of the conveyor belt.

The conveyor belt with printing blocks 23 and 24 forming line 20 is assigned to the upper strand of the conveyor belt with tampons 13 and 14. This conveyor belt forming line 20 is guided around deflection pulleys 21 and 22 and carries printing blocks 23 and 24 in the same spacing, since both conveyor belts are of identical design and configuration. The direction of rotation is selected so that the upper strand of the conveyor belt with tampons 13 and 14 is arranged at a distance and parallel to the lower strand of the conveyor belt with the printing blocks 23 and 24 and that these two strands of the two conveyor belts are moved in the same direction in this section. This means that the conveyor belt with printing blocks 23 and 24 has to move clockwise, when the conveyor belt with tampons 13 and 14 moves counterclockwise. Inking device 25 is assigned to the upper strand of the conveyor belt with printing blocks 23 and 24. Then, printing blocks 23 and 24 are continuously inked when they pass through or are guided past inking device 25.

The conveyor belt with the workpiece holders receiving workpieces 33 and 34 which forms endless line 30 is assigned to the lower strand of the conveyor belt with tampons 13 and 14. Here, the upper strand with workpiece 33 is moved in the same direction as the lower strand of the conveyor belt with tampons 13 and 14. The conveyor belt with the workpiece holders is guided around deflection pulleys 31 and 32 and is configured identical to the conveyor belt with tampons 13 and 14 as well as the conveyor belt with printing blocks 23 and 24. To achieve a synchronous rotational motion it is simplest to drive all three conveyor belts with a common drive mechanism which can be coupled in the same way, for instance with deflection pulleys 11, 21, and 31. The distances of the synchronous sections of the conveyor belts with printing blocks 23 and 24 and tampons 13 and 14, as well as the sections of the conveyor belts with tampons 13 and 14 and the workpiece holders are identical and are made to fit the dimensions of tampons 13 and 14.

When the conveyor belts are made to rotate continuously, the strands of the conveyor belts are moved in the directions of the arrows shown. Printing blocks 23 and 24 are inked. If the conveyor belt strand is adjusted upward when the upper strand of the conveyor belt with tampons 13 and 14 completes its pass over deflection pulley 11 which can be done by a controlled deflection or a positive guidance of the conveyor belt itself, then tampon 13 and printing block 23 are in a position to interact. This interaction remains in effect until tampon 13 is moved downwards and is lifted off printing block 23. In this process, the printing image is received by tampon 13 from inked printing block 23. Here, tampon 13 must be adjusted upwards to the extent that it can execute its maximum deflection path. The adjustment can be selected according to the size of the printing image and can be limited correspondingly. At the same time, when the lower strand of the conveyor belt completes its pass over deflection pulley 11 tampon 14 can be adjusted downward and is made to interact with workpiece 33. The adjusting path is coordinated with and limited to the required deflection path of tampon 14. Before the lower strand enters deflection pulley 12, tampon 14 is adjusted upward again and removed from workpiece 33. During the period of interaction which is maintained on part of the synchronous sections, the printing image has been transferred from inked tampon 14 to workpiece 33.

The conveyor belts can be set in motion at a great speed. The adjustment paths of tampons 13 and 14 which are perpendicular to the conveyor belt strands are short with enough time left for the necessary deflection of tampons 13 and 14. In one rotation of the conveyor belts with tampons 13 and 14 both tampons 13 and 14 will receive printing images from printing blocks 23 and 24 and transfer them to workpieces 33 and 34. The conveyor belts must be aligned so that in one position printing blocks 23 and 24, tampons 13 and 14, and workpieces 33 and 34 or their work piece holders are located on the center axis of all three conveyor belts which is perpendicular to the transporting strands.

The length of the transporting strands which form the synchronous sections of endless lines 10, 20, and 30, and the speed of rotation are the parameters which determine the printing speed. The adjustment path of tampons 13 and 14 which is perpendicular to the transporting strands must move in the direction of the arrows shown and must be started and completed while these sections pass through.

Figure 2:
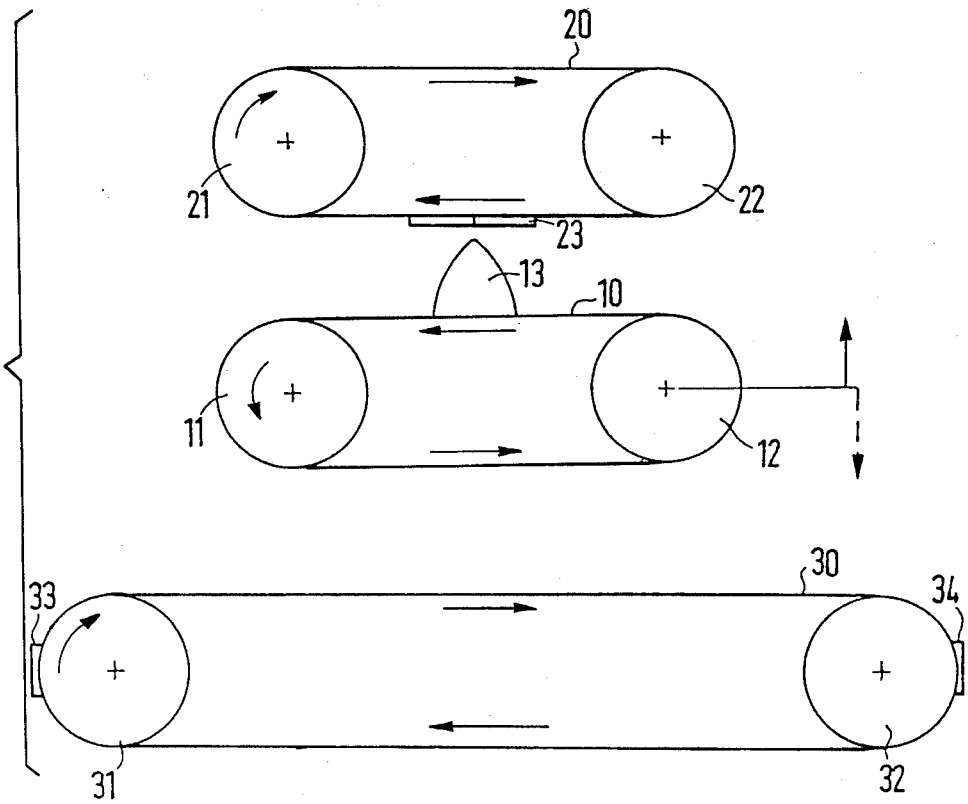

In the exemplified embodiment according to FIG. 2 the central conveyor belt carries only tampon 13 and the upper conveyor belt only printing block 23. Thus, the spacing is determined by the length of these two identical conveyor belts. The lower conveyor belt has workpiece holders for two workpieces 33 and 34 which are spaced at an equal distance on the conveyor belt which is twice as long. The arrows indicate the direction of motion of the transporting strands of the conveyor belt. When tampon 13 passes through the upper strand of the conveyor belt, the complete conveyor belt which forms line 10 is lifted so that tampon 13 interacts with printing block 23 with suitable deflection. When the printing image transfer is complete the conveyor belt with tampon 13 returns to its central position with tampon 13 lifting off printing block 23. When inked tampon 13 enters the lower strand of the conveyor belt, the complete conveyor belt with tampon 13 is adjusted downwards. In the meantime, workpiece 33 has been moved on endless line 30 so that it can interact on the upper strand with lowered tampon 13. The printing image is transferred from inked tampon 13 to workpiece 33. After a quarter of the rotation on line 30 the interaction between tampon 13 and workpiece 33 is discontinued and is subsequently followed again by the inking procedure of tampon 13 at printing block 23. Beforehand, line 10 was returned to the center position and then adjusted upward again.

Figure 3:
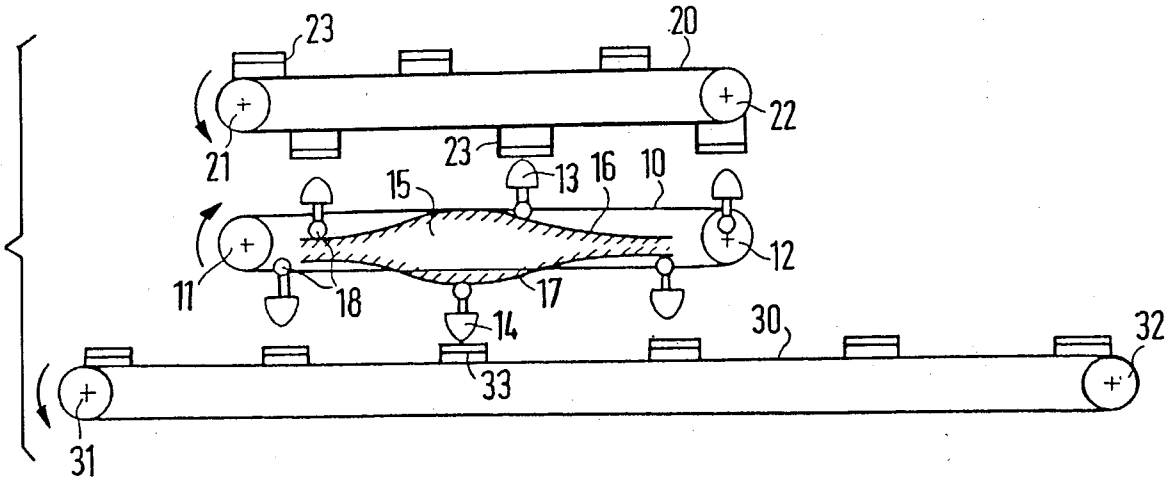

Finally, FIG. 3 shows an exemplified embodiment where line 10 is equipped with with six tampons 13 and line 20 with six printing blocks 23. A shunt 15 is assigned to line 10 with tampons 13, which shunt has the two control curves 16 and 17. Tampons 13 have control carriers 18, which rest on control curves 16 and 17 when passing through the synchronous sections, i.e. the two strands of line 10, and which control the adjustment of tampons 13 for receiving the printing image from printing blocks 23 and for transferring the printing image to workpieces 33.

The conveyor belt which forms line 30 has a number of workpiece holders which number is larger than the number of tampons 13 and the number of printing blocks 23. The speeds of rotation of all conveyor belts is the same, so that a uniform spacing of tampons 13, printing blocks 23, and workpieces 33 ensures that the interactive connections from tampons 13 to printing blocks 23 and to workpieces 33 are established and interrupted again continuously when tampons 13 are adjusted via control curves 16 and 17. In this connection, the number of workpieces 33 is preferentially an integral multiple of the number of tampons 13 or the number of printing blocks 23. In this way, one rotation of line 30 is matched by a corresponding number of rotations of lines 10 and 20, which number is determined by this integral multiple.

The ends of line 30 have a section protruding at both ends of line 10. In these protruding sections access to the workpiece holders is facilitated which favors feeding the workpieces to be printed to the workpiece holder on the one hand, and removing the printed workpieces from the workpiece holders on the other hand.

We claim:

1. Apparatus for high-speed tampon printing wherein tampons alternately receive images from inked printing blocks and transfer such images to workpieces, said apparatus comprising: at least three endless lines, a first endless line retaining printing blocks, a second endless line retaining tampons, and a third endless line retaining workpieces; means for moving said three endless lines synchronously, at least a first section of said second endless line retaining tampons arranged parallel to and moving in the same direction as a section of said first endless line retaining printing blocks, and at least a second section of said second endless line retaining tampons arranged parallel to and moving in the same direction as a section of said third endless line retaining workpieces; and means for adjusting said tampons perpendicularly to the corresponding section of said second endless line to bring a tampon alternately into a position to interact with an inked printing block retained by said section of said first endless line for receiving a printing image and to interact with a workpiece retained by said section of said third endless line transferring said printing image.

2. Apparatus as set forth in claim 1 wherein said first, second and third endless lines comprise conveyor belts, and multiple said printing blocks, tampons, and workpieces are arranged on said conveyor belts with equal spacing.

3. Apparatus as set forth in claim 2 additionally comprising an inking means provided peripherally to said first endless line for transferring said printing image to said printing blocks.

4. Apparatus as set forth in claim 2, wherein said conveyor belts retaining said tampons, printing blocks, and workpieces have the same configuration; two tampons, two printing blocks, and two workpieces are retained on said second, first and third endless lines, respectively, and said tampons, printing blocks, and workpieces are arranged correspondingly at intervals which equal half the length of said conveyor belts.

5. Apparatus as set forth in claim 4, wherein said means for moving said first, second and third endless lines synchronously comprises a common drive mechanism operatively connected to each of said first, second and third endless lines.

6. Apparatus as set forth in claim 5, wherein an equal number of said tampons and said printing blocks are provided, and the number of said workpieces is larger than the number of said tampons and said printing blocks.

7. Apparatus as set forth in claim 6, wherein several said second endless lines retaining said tampons are provided and aligned with a single third endless line retaining said workpieces, said second endless lines retaining said tampons are arranged in parallel with one another and with said third endless line, and said apparatus additionally comprises means for moving each said second endless line synchronously and in the same direction, and one said first endless line retaining printing blocks is provided for and aligned with each said second endless line.

8. Apparatus as set forth in claim 2, wherein said means for adjusting said tampons perpendicularly comprises a shunt with control curves for deflecting said tampons; and said tampons additionally comprise control carriers engaged with said second endless line.

9. Apparatus as set forth in claim 8, wherein said control curves of said shunt are provided at and correspond to said first and second sections of said second endless line.

10. Apparatus as set forth in claim 1 wherein said means for moving said first, second and third endless lines synchronously comprises a common drive mechanism operatively engaged with each of said first, second and third endless lines.

11. Apparatus as set forth in claim 1, wherein two tampons, two printing blocks, and two workpieces are retained on said second, first and third endless lines, respectively; said first, second and third endless lines retaining said tampons, printing blocks, and workpieces have the same configuration; and said tampons, printing blocks and workpieces are arranged correspondingly at intervals which equal half the length of said second endless line.

12. Apparatus as set forth in claim 1, wherein an equal number of said tampons and said workpieces is larger than the number of said tampons and said printing blocks.

13. Process for high speed tampon printing, comprising:

arranging at least one printing block on a first endless line, arranging at least one tampon aligned with said at least one printing block on a second endless line, and arranging at least one workpiece aligned with said at least one tampon on a third endless line, and arranging said first, second and third endless lines parallel to one another;

synchronously moving said first, second and third endless lines, a first section of said second endless line moving in the same direction as a section of said first endless line, and a second section of said second endless line moving in the same direction as a section of said third endless line;

transferring a printing image from said at least one printing block on said first endless line to said at least one tampon on said second endless line by adjusting said tampon and said printing block relative to one another in a direction perpendicular to the corresponding sections of said first and second endless lines;

and transferring said printing image from said at least one tampon on said second endless line to said at least one workpiece on said third endless line by adjusting said tampon and said workpiece relative to one another in a direction perpendicular to the corresponding sections of said second and third endless lines.

14. Process as set forth in claim 13, wherein said first, second and third endless lines are continuously moved at a constant speed.

15. Process as set forth in claim 14, wherein said transferring of said printing image is achieved by adjusting said at least one tampon in said direction perpendicular to said second endless line for a pre-determined time period during the moving of said endless lines.

16. Process as set forth in claim 15, wherein said adjustments of said tampon in said direction perpendicular to said first, second and third endless lines are achieved by deflecting the corresponding sections of said second endless line.

17. Process as set forth in claim 15, wherein said adjustments of said tampon in said direction perpendicular to said first, second and third endless lines are achieved by displacing the entire said second endless line.

18. Process as set forth in claim 15, additionally comprising transferring said printing image to said at least one printing block by contacting said at least one printing block to an inking device.

19. Process as set forth in claim 13, wherein said transferring of said printing image is achieved by adjusting said at least one tampon in said direction perpendicular said second endless line for a predetermined time period during the continuous movement of said first, second and third endless lines.

20. Process as set forth in claim 13, wherein said adjustments of said at least one tampon in said direction perpendicular to said first, second and third endless lines are achieved by displacing the entire said second endless line.

21. Process as set forth in claim 13, additionally comprising transferring said printing image to said at least one printing block by contacting said at least one printing block to an inking device.

* * * * *